US012584625B2

(12) United States Patent
Flint et al.

(10) Patent No.: US 12,584,625 B2
(45) Date of Patent: Mar. 24, 2026

(54) GAS BURNER MEMBRANE

(71) Applicant: Beckett Thermal Limited, Alfreton (GB)

(72) Inventors: Darren Flint, Alfreton (GB); Matthew Philip Bower, Alfreton (GB)

(73) Assignee: Beckett Thermal Limited, Alfreton (GB)

( * ) Notice: Subject to any disclaimer, the term of this patent is extended or adjusted under 35 U.S.C. 154(b) by 434 days.

(21) Appl. No.: 18/109,246

(22) Filed: Feb. 13, 2023

(65) Prior Publication Data

US 2023/0258331 A1 Aug. 17, 2023

(30) Foreign Application Priority Data

Feb. 14, 2022 (GB) ..... 2201912

(51) Int. Cl.
*F23D 14/14* (2006.01)

(52) U.S. Cl.
CPC .... *F23D 14/145* (2013.01); *F23D 2203/1023* (2013.01); *F23D 2203/1026* (2013.01)

(58) Field of Classification Search
CPC ..... F23D 14/145; F23D 2203/1023; F23D 2203/1026; F23D 2203/102; F23D 2203/106; F23D 2203/108
USPC ..... 431/328
See application file for complete search history.

(56) References Cited

U.S. PATENT DOCUMENTS

| | | | | |
|---|---|---|---|---|
| 3,695,818 | A * | 10/1972 | Mizutani | F23D 14/147 431/328 |
| 5,104,309 | A * | 4/1992 | Krieger | F23D 14/145 126/92 AC |
| 5,368,476 | A * | 11/1994 | Sugahara | F23D 14/58 431/328 |
| 2013/0059258 | A1* | 3/2013 | Min | F23D 14/586 431/354 |

FOREIGN PATENT DOCUMENTS

| | | | |
|---|---|---|---|
| CN | 206831488 | U | 1/2018 |
| DE | 1810308 | U | 4/1960 |
| EP | 0146976 | A1 | 7/1985 |
| EP | 2626627 | A1 | 8/2013 |
| EP | 2899463 | A1 | 7/2015 |
| JP | S5312531 | A | 2/1978 |

OTHER PUBLICATIONS

"Search Report for Great Britain Patent Application No. 2201912.9", Mailed Date: Feb. 21, 2023, 6 pages.
"Extended European Search Report for European Patent Application No. 23156645.6", Mailed Date: Aug. 21, 2023, 6 pages.

* cited by examiner

*Primary Examiner* — Vivek K Shirsat
(74) *Attorney, Agent, or Firm* — CALFEE, HALTER & GRISWOLD LLP

(57) ABSTRACT

A gas burner membrane is provided. The gas burner membrane comprises a plurality of first layers, each first layer comprises at least one inlet formed therein for receiving a combustible gas mixture, and a plurality of second layers. Successive first layers are separated by a second layer, and at least one outlet is formed between successive first layers.

20 Claims, 12 Drawing Sheets

GAS BURNER MEMBRANE

TECHNOLOGICAL FIELD

Embodiments of the present disclosure relate to a gas burner membrane. Some relate to a method of forming the gas burner membrane.

BACKGROUND

In gas burners for instance in boilers, cookers, gas fires or other systems, a gas burner membrane is usually provided which has a pattern of through holes through which a mixture of gas and air pass. The mixture is ignited on an outer side, i.e., a combustion side, of the gas burner membrane. Burner membranes may also be called flame strips, flame skins, burner skins or burner heads. A required size and pattern/density of through holes is required to provide efficient burning on the outer side of the gas burner membrane, and to retain the burning on the outer side of the gas burner membrane at a required space therefrom.

Conventionally gases such as methane have been used in gas burners in a number of locations. In some instances, alternative gases could be used in gas burners, such as pure hydrogen gas, a hydrogen rich gas mixture, or a blend of hydrogen and methane.

BRIEF SUMMARY

According to various, but not necessarily all, embodiments there is provided a gas burner membrane. The gas burner membrane comprises a plurality of first layers, each first layer comprises at least one inlet formed therein for receiving a combustible gas mixture, and a plurality of second layers. Successive first layers are separated by a second layer, and at least one outlet is formed between successive first layers.

The gas burner membrane may comprise an alternating sequence of first and second layers.

Each first layer may be aligned with adjoining second layers such that an escape path is formed between the inlet of the first layers and adjoining outlets. The escape path may allow the received combustible gas mixture to flow from the inlet of the first layer to the adjoining outlets.

Each of the second layers may comprise at least one outlet formed therein.

Each first layer may be aligned with adjoining second layers such that an escape path is formed between the inlet of the first layer and the outlets of adjoining second layers. The escape path may allow the received combustible gas mixture to flow from the inlet of the first layer to the outlets of adjoining second layers.

At least one first layer may comprise at least one outlet formed therein. The outlet formed in the first layer may be spaced from the formed inlet of the first layer in a first dimension. At least one second layer adjoining the at least one first layer may comprise at least one inlet formed therein. The inlet formed in the second layer may be spaced from the formed outlet of the second layer in the first dimension such that a further escape path is formed between the outlet of the first layer and the inlet of the adjoining second layer.

The first dimension may be defined by the longest extent of the first and second layers.

At least one second layer may comprise at least one arm. The at least one arm may form a plurality of outlets between successive first layers.

Each first layer adjoining a second layer comprising at least one arm may comprise the same number of inlets formed therein as outlets between successive first layers. Each arm of the second layer may be positioned between inlets formed in each first layer.

The first and second layers may have a length, width and depth. The length may be longer than the width and depth. The width may be shorter than the length and longer than the depth. The depth may be shorter than the length and the width.

The gas burner membrane may comprise a plurality of sets of inlets. Each set of inlets may comprise a plurality of inlets. The inlets of each set may be aligned with each other along a dimension defined by the depth of the layers. The plurality of sets of inlets may be spaced from each other in a dimension defined by the length and width of the layers.

The gas burner membrane may comprise a plurality of sets of outlets. Each set of outlets may comprise a plurality of outlets. The outlets of each set may be aligned with each other along a dimension defined by the depth of the layers. The plurality of sets of outlets may be spaced from each other in a dimension defined by the length and width of the layers.

The depth may be further defined by the longest extent of the gas burner membrane.

The cross-sectional area of each outlet may be greater than the cross-sectional area of the narrowest portion of each inlet.

Each inlet may comprise an opening and a neck portion proximal to the opening. The cross-sectional area of the inlet may be lowest at the neck portion.

Each inlet may comprise a barrier distal from the opening. Each inlet may taper inwardly from the opening to the neck portion, and may taper outwardly from the neck portion to the barrier.

The distance between successive first layers may be at least 2 mm or less, or preferably 1 mm or less, or preferably 0.5 mm or less.

Each second layer may have a depth of 2 mm or less, or preferably 1 mm or less, or preferably 0.5 mm or less.

According to various, but not necessarily all, embodiments there is provided a method. The method comprises providing a plurality of first layers, each first layer comprises at least one inlet formed therein for receiving a combustible gas mixture, providing a plurality of second layers, and arranging the plurality of first and second layers in an alternating sequence such that successive first layers are separated by a second layer. At least one outlet is formed between successive first layers.

According to various, but not necessarily all, embodiments there is provided a gas burner membrane. The gas burner membrane comprises a plurality of inlets for receiving a combustible gas mixture, each inlet is formed in a respective layer, and a plurality of outlets for forming and maintaining a flame from the combustible gas mixture. The outlets are formed between successive layers.

According to various, but not necessarily all, embodiments there is provided a gas burner membrane. The gas burner membrane comprises a plurality of inlets for receiving a combustible gas mixture, a plurality of outlets for forming and maintaining a flame from the combustible gas mixture, and an internal flashback chamber. The internal flashback chamber comprises at least one barrier arranged to impede the flow of combustible gas mixture that has been received by the plurality of inlets, and arranged to deflect the received combustible gas mixture towards the plurality of outlets.

The barrier of the internal flashback chamber may be shaped such that the flow of the combustible gas mixture impeded by the barrier has an orthogonal component at or near the barrier.

The internal flashback chamber may comprise a respective barrier for each inlet.

The internal flashback chamber may extend substantially along the longest extent of the gas burner membrane.

The gas burner membrane may comprise a plurality of sets of inlets. Each set of inlets may comprise a plurality of inlets. The gas burner membrane may comprise an internal flashback chamber for each set of inlets. Each internal flashback chamber may comprise at least one barrier arranged to impede the flow of combustible gas mixture that has been received by the respective set of inlets, and arranged to deflect the received combustible gas mixture towards an outlet.

The gas burner membrane may comprise a plurality of sets of outlets. Each set of outlets may comprise a plurality of outlets. The at least one barrier of each internal flashback chamber may be arranged to deflect the received combustible gas mixture towards a respective set of outlets.

The gas burner membrane may comprise a plurality of layers which form the inlets, outlets and internal flashback chamber.

According to various, but not necessarily all, embodiments there is provided a method of forming a gas burner membrane. The method comprises forming a plurality of inlets for receiving a combustible gas mixture, forming a plurality of outlets for forming and maintaining a flame from the combustible gas mixture, and forming an internal flashback chamber. The internal flashback chamber comprises at least one barrier arranged to impede the flow of combustible gas mixture that has been received by the plurality of inlets, and arranged to deflect the received combustible gas mixture towards the plurality of outlets.

According to various, but not necessarily all, embodiments there is provided a method for detecting flashback. The method comprises providing a gas burner membrane comprising an internal flashback chamber, and, during operation, detecting an absence of a flame at any of the outlets of the gas burner membrane and/or if a temperature in the internal flashback chamber of the gas burner membrane is above a threshold.

The method may comprise ceasing to supply combustible gas mixture to the gas burner membrane upon detection of an absence of a flame at any of the outlets of the gas burner membrane and/or a temperature in the internal flashback chamber of the gas burner membrane above a threshold.

According to various, but not necessarily all, embodiments there is provided examples as claimed in the appended claims.

BRIEF DESCRIPTION

Some examples will now be described with reference to the accompanying drawings in which:

FIG. 1 shows a schematic diagram of a first example gas burner membrane;

FIGS. 2A-D illustrate an example of the first example gas burner membrane;

Figure 6A:
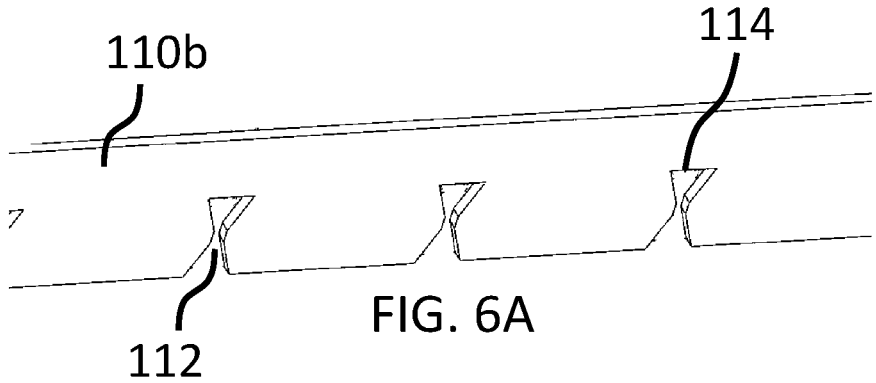
Figure 6B:
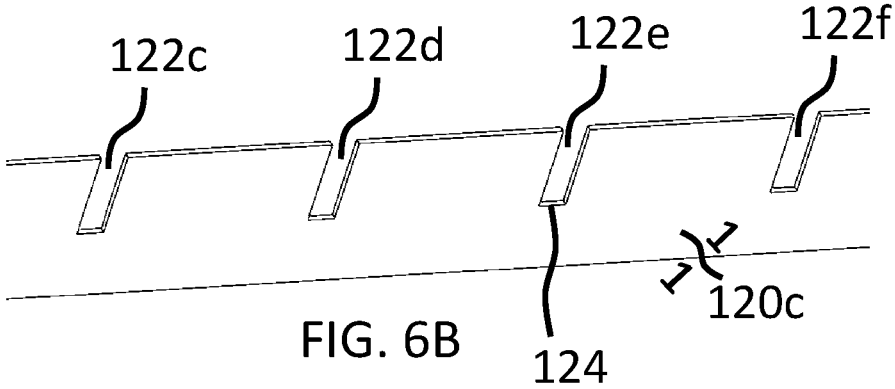
Figure 6C:
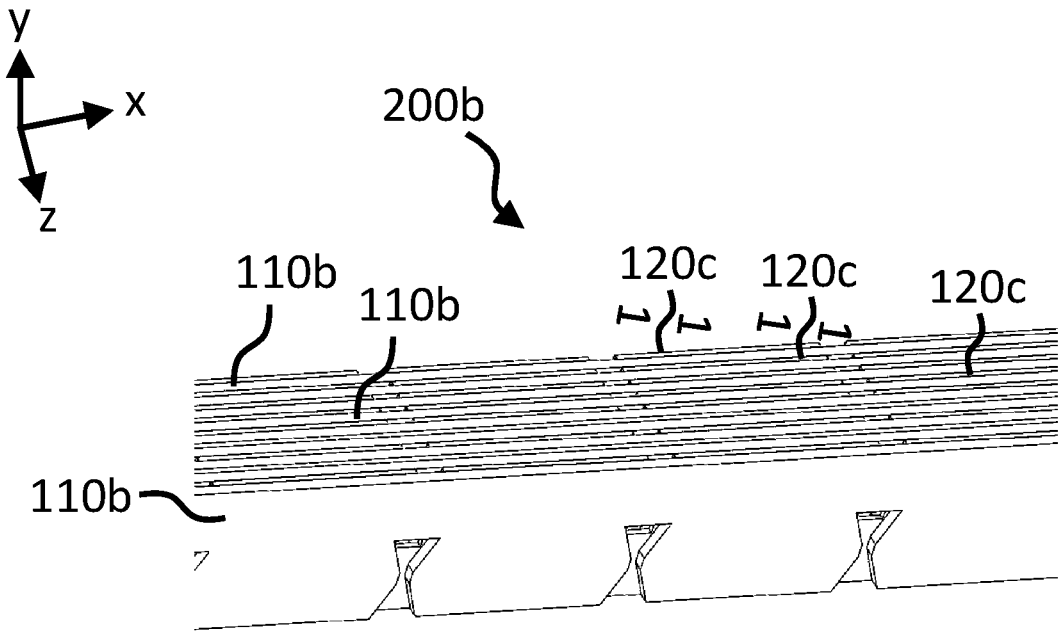
Figure 7:
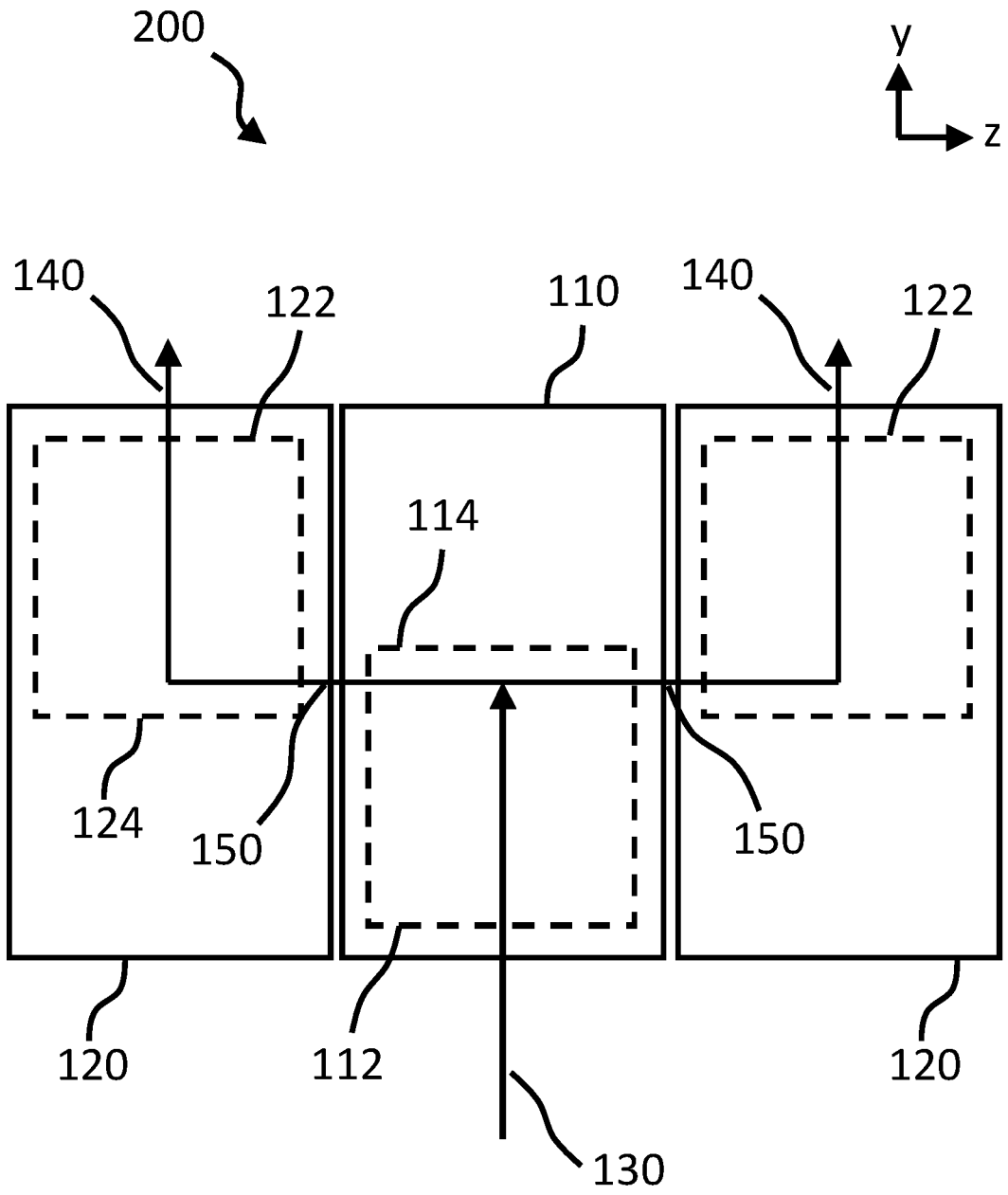
Figure 8A:
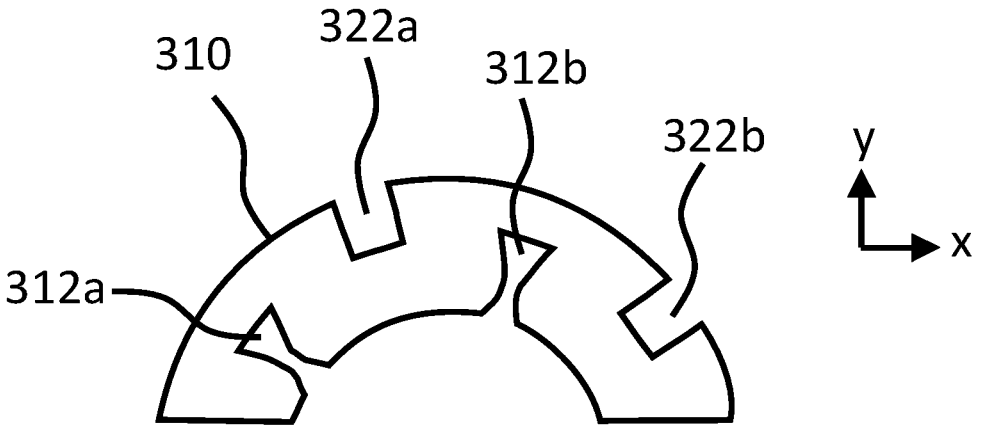
Figure 8B:
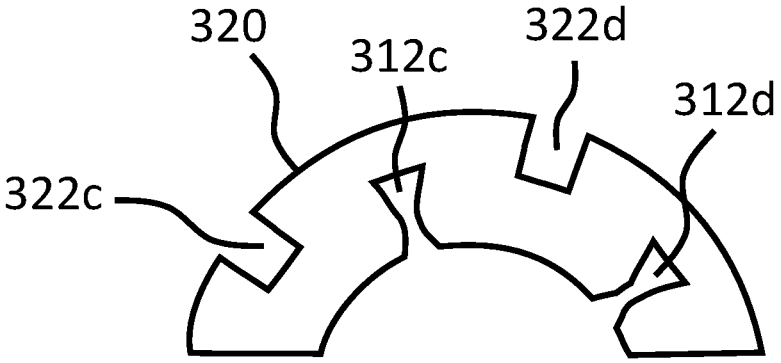
Figure 8C:
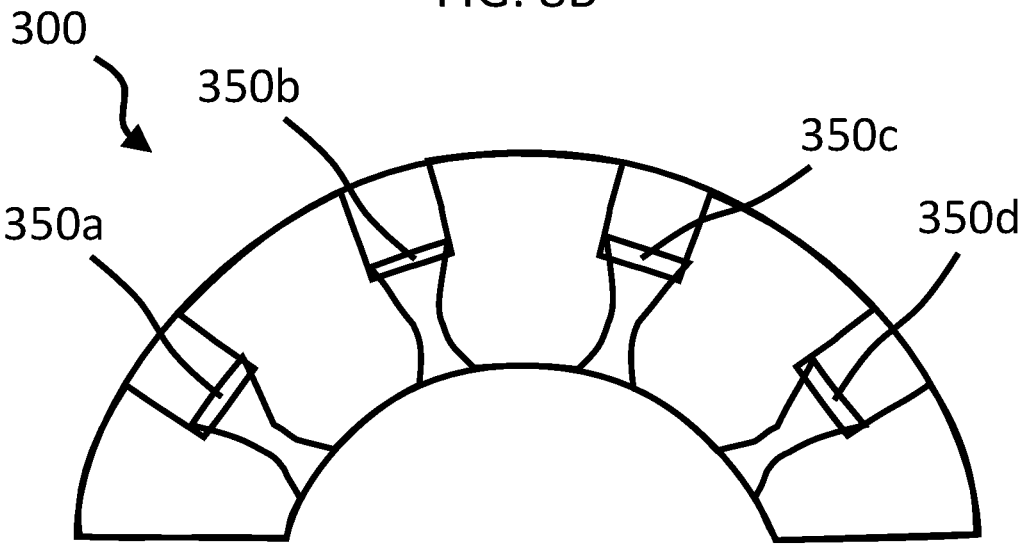
Figure 9:
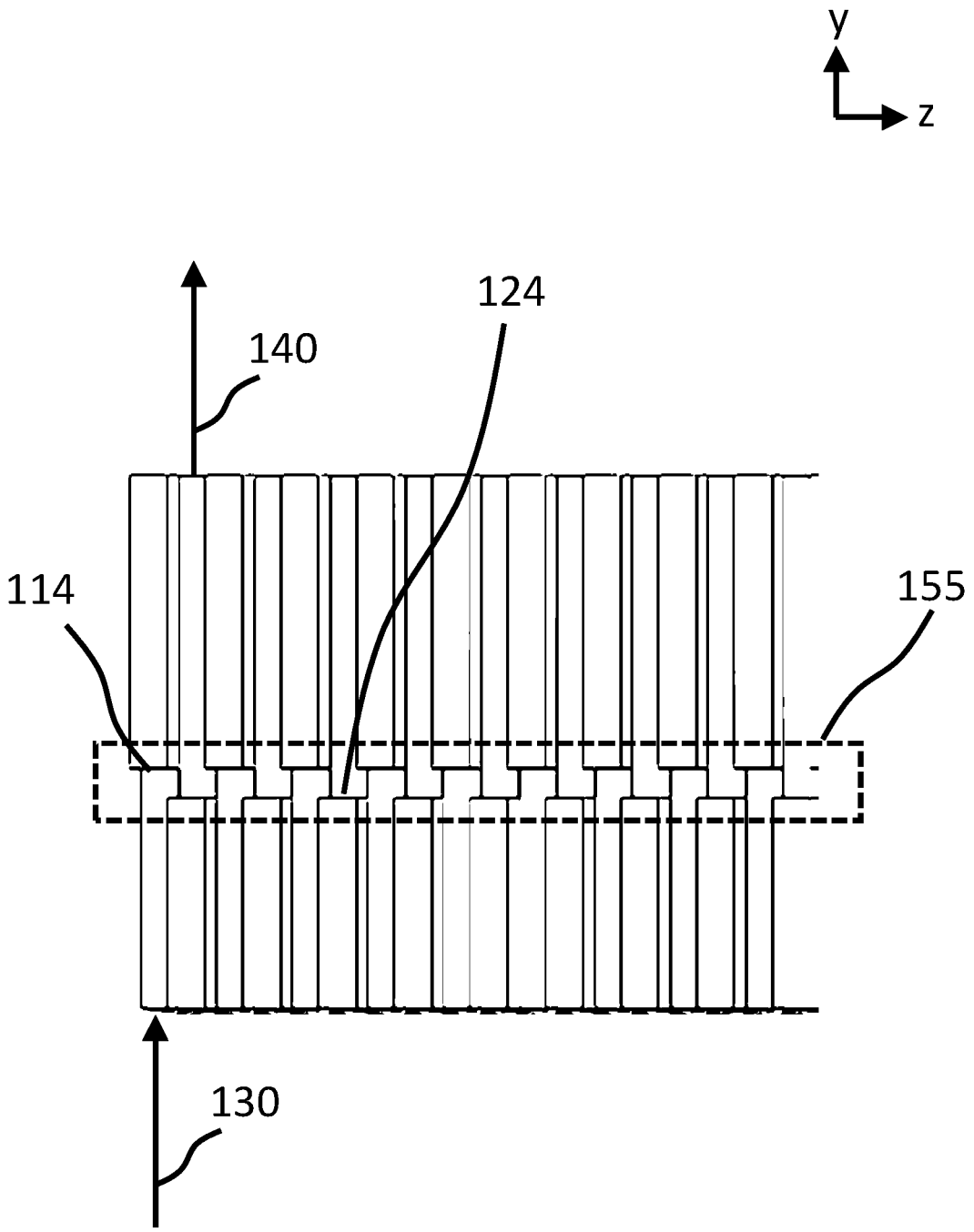
Figure 10:
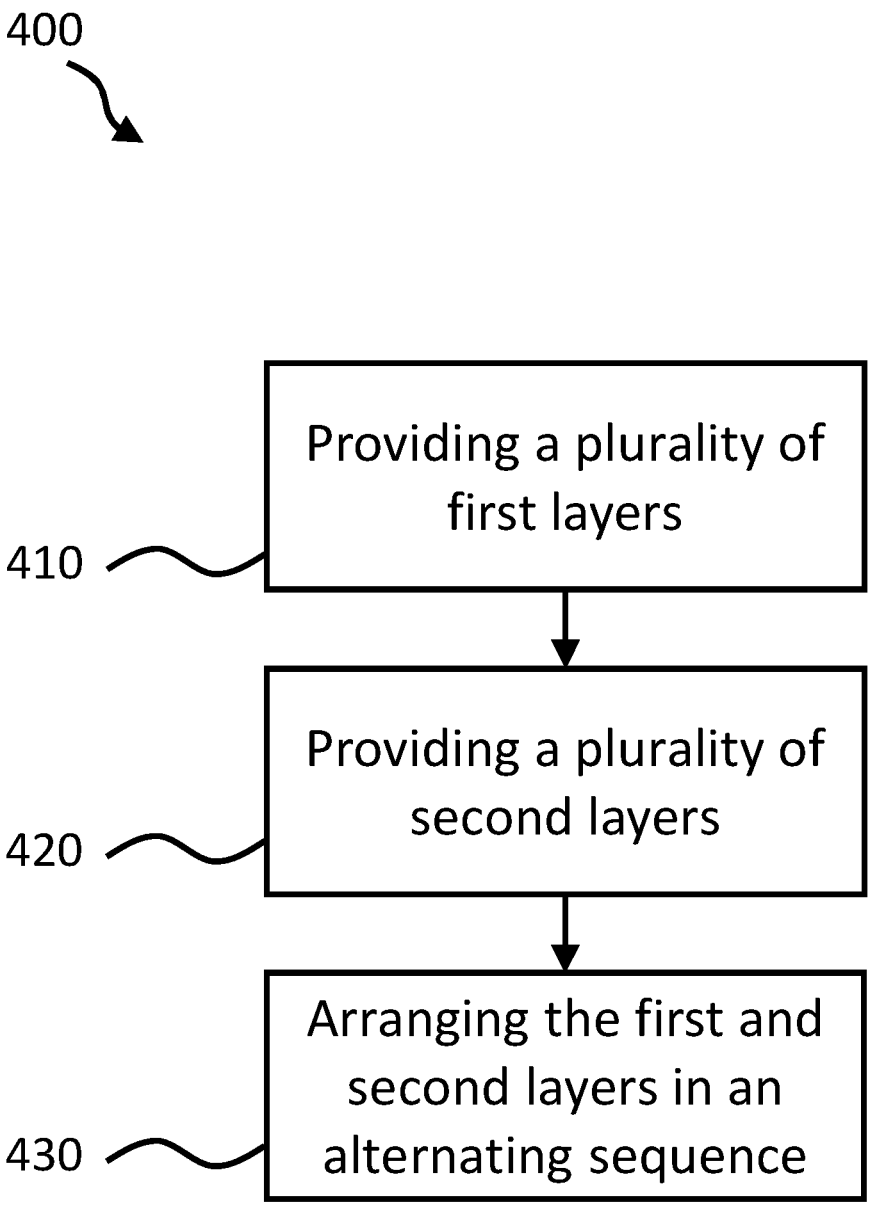
Figure 11:
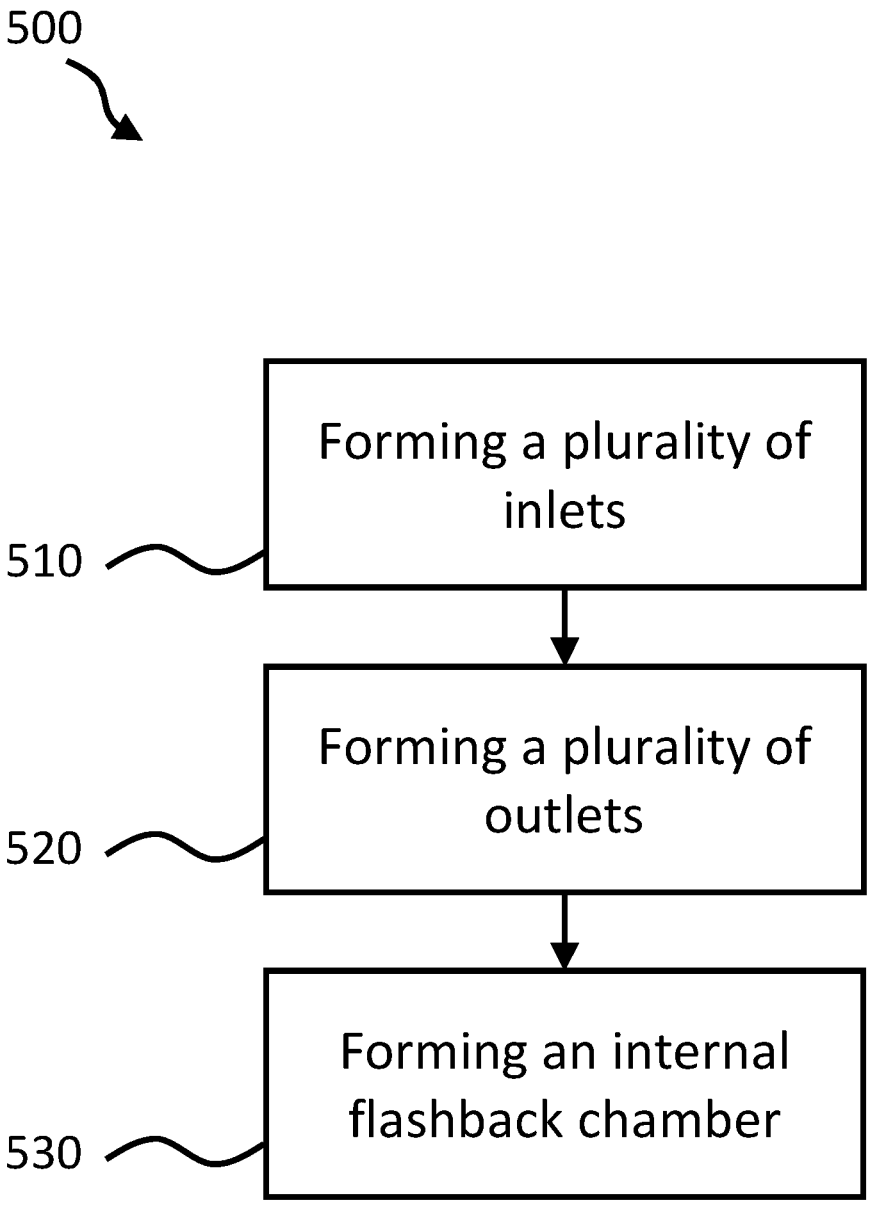
Figure 12:
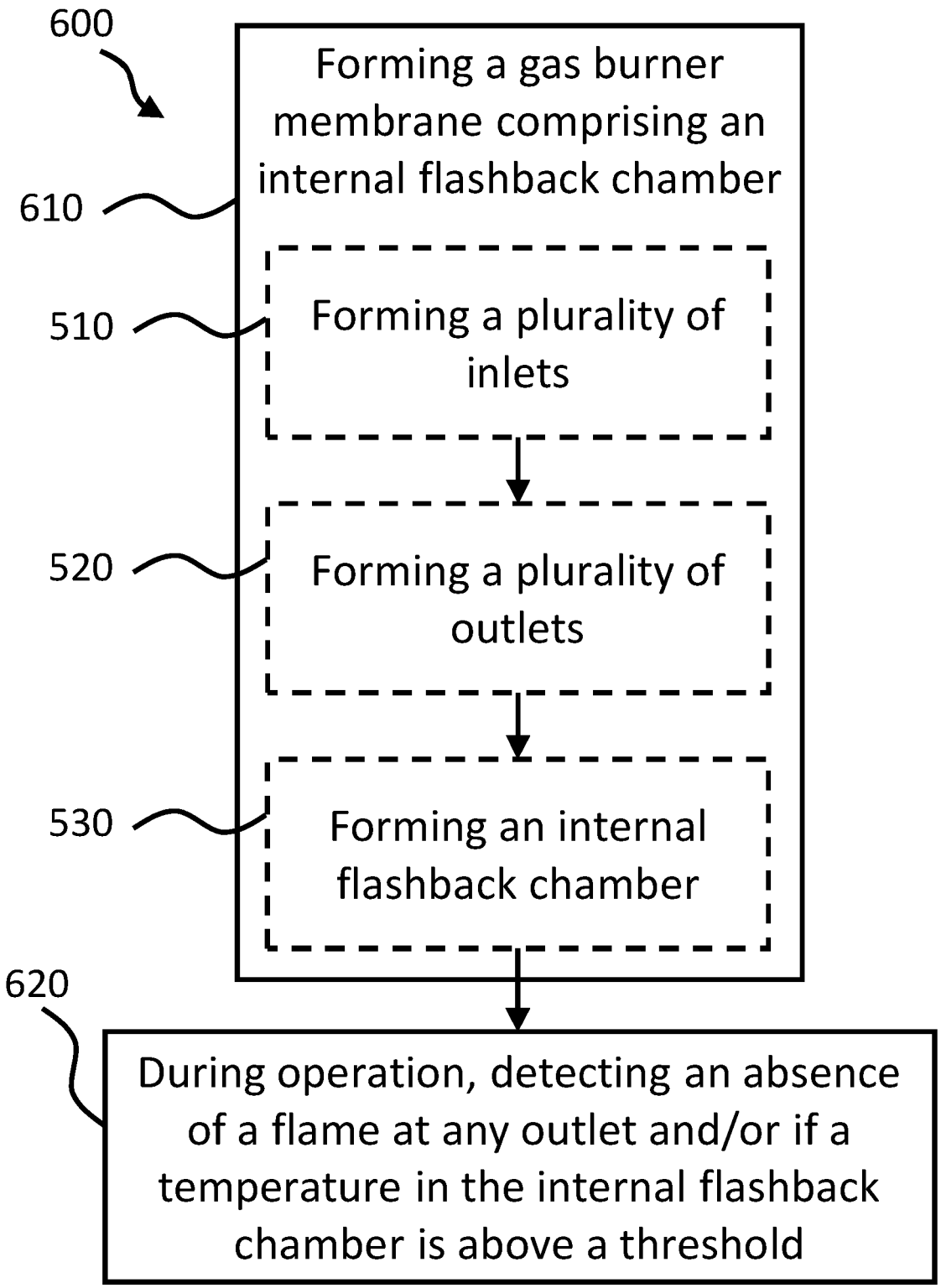

FIGS. 5A-D illustrate a first example of the second example gas burner membrane;

FIGS. 6A-C illustrate a second example of the second example gas burner membrane;

FIG. 7 shows a flow path of the second example gas burner membrane;

FIGS. 8A-C illustrate an example of a third example gas burner membrane;

FIG. 9 shows a schematic diagram of an internal flashback chamber;

FIG. 10 is a flowchart of a first method of forming a gas burner membrane;

FIG. 11 is a flowchart of a second method of forming a gas burner membrane; and FIG. 12 is a flowchart of a method for detecting flashback.

DETAILED DESCRIPTION

Embodiments of the invention relate to a gas burner membrane and associated method.

Figure 1:
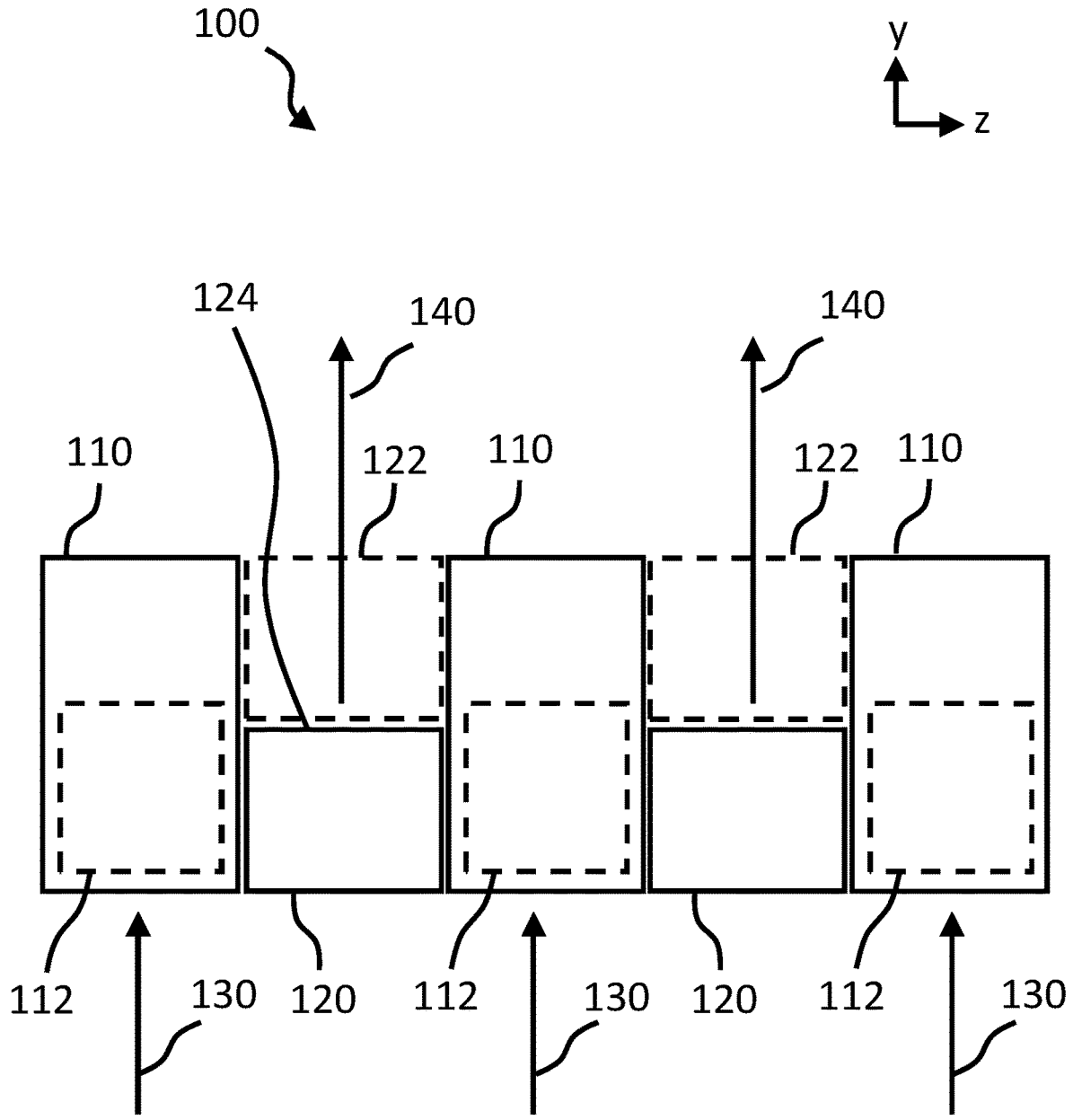

FIG. 1 shows a schematic diagram of a first example gas burner membrane 100. The gas burner membrane 100 depicted in FIG. 1 comprises five discrete layers. However, it is envisaged that more or fewer layers may be used.

The illustrated gas burner membrane 100 comprises a plurality of first layers 110 and a plurality of second layers 120, specifically three first layers 110 and two second layers 120. As shown, the first 110 and second layers 120 are adjoined along the z-dimension. The longest extent of the gas burner membrane 100 may also be defined along the z-dimension.

Each of the first layers 110 and second layers 120 has a length, width and depth. The length is longer than the width and depth, the width is shorter than the length and longer than the depth, and the depth is shorter than the length and the width. In FIG. 1, the length dimension of the layers is aligned with the x-dimension (which extends out of the page and is orthogonal to the y- and z-dimensions). The width dimension of the layers is aligned with the y-dimension (which is orthogonal to the x- and z-dimensions). The depth dimension of the layers is aligned with the z-dimension (that is orthogonal to the x- and y-dimensions), which may also be aligned with the longest extent of the gas burner membrane 100.

The gas burner membrane 100 shows an alternating sequence of first layers 110 and second layers 120. In other words, each successive first layer 110, i.e., each subsequent first layer 110 in the sequence of layers, is separated by a second layer 120. For example, the gas burner membrane 100 comprises a first layer 110 adjoining a second layer 120, which adjoins another first layer 110, which adjoins another second layer 120, and so on. The first layers 110 and the second layers 120 of the gas burner membrane 100 are arranged in close contact such that gas is inhibited from flowing where the adjoining layers make contact.

Each of the first layers 110 comprises at least one inlet 112 formed therein for receiving a combustible gas mixture. Combustible gas mixture flows into the gas burner membrane 100 through the inlets 112 (i.e., from a cool side of the gas burner membrane 100) in a plus y-direction as shown by arrows 130 in FIG. 1. In other words, the combustible gas mixture is supplied to the gas burner membrane 100 from the cool side of the gas burner membrane 100. Second layers 120 adjoining first layers 110 at least partially restrict the combustible gas mixture received by each inlet 112 in the first layers 110.

The flow of combustible gas mixture entering the gas burner membrane 100 may be from a mixing chamber (not shown) which is fluidly connected to each inlet 112 in the first layers 110. The mixing chamber may be configured to receive a mix of gas fuel (such as natural gas, hydrogen, a blend, or the like) and air which forms the combustible gas mixture, or mix the gas fuel and air to form the combustible gas mixture.

At least one outlet 122 is formed between successive first layers 110. In other words, the gas burner membrane 100 comprises a plurality of outlets 122, where each outlet 122 is for forming and maintaining a flame. In this example, the outlets 122 are formed by a space between successive first layers 110. In other words, successive first layers 110 at least partially restrict the combustible gas mixture received by the outlet 122 between the first layers 110. An edge 124 of each second layer 120 also defines a boundary of the outlets 122 in this example.

Combustible gas mixture exits the gas burner membrane 100 through the outlets 122, typically for ignition at a combustion side of the gas burner membrane 100, in a plus y-direction as shown by arrows 140 in FIG. 1. For example, a flame or flames is/are formed at the combustion side of the gas burner membrane 100 from the combustible gas mixture.

The distance between successive first layers 110 may be at least 2 mm or less. It may be 1 mm or less, or 0.5 mm or less. The distance may depend on the application for the gas burner membrane and/or the combustible gas mixture being used. It may be that the distance between successive first layers 110 is determined by the thickness, or depth, of the second layers 120. That is, the second layers 120 may have a thickness of 2 mm or less, or 1 mm or less, or 0.5 mm or less. It may be that when a hydrogen or hydrogen-rich combustible gas mixture is used, the second layers 120 have a thickness of 0.5 mm or less.

It may be that the layers of the gas burner membrane 100 are formed from metal or a composite. For example, the layers may be formed from stainless steel or ferritic stainless steel. In some examples, the layers of the gas burner membrane 100 may be formed from sintering, or from cutting sheet metal. Alternatively, the layers of the gas burner membrane 100 may be formed from ceramic.

It may be that the layers of the gas burner membrane 100 are fixed together. For example, the layers may be pressed together. A connector, such as a rod, may be used to assist in aligning the layers and holding the layers together. Each layer may comprise a hole (not shown) for receiving the connector. Fasteners may be used to hold the layers together. The fasteners may be, for example, locking washers such as spring washers. The layers may be held together by welding them together. The layers may be held together by heating the layers under pressure.

An example of the first layers 110*a* and second layers 120*a* used for the first example gas burner membrane 100, as shown in FIG. 1, is illustrated in FIGS. 2A-D. In this example, the first layer 110*a* is illustrated as being curved, but any shape may be used. The first layers 110*a* may, for example, be referred to as a distributor layer or distributor blade, and the second layers 120*a* may, for example, be referred to as a port layer or port blade.

Figure 2A:
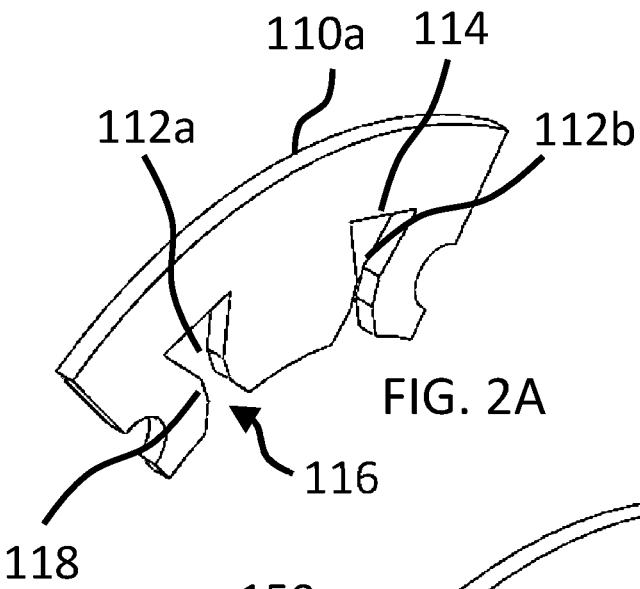

As shown in FIG. 2A, the first layers 110*a* comprise two inlets 112*a-b* formed therein. Each inlet 112*a-b* formed in the first layer 100 comprises an opening 116 and a neck portion 118. The neck portion 118 is proximal to the opening 116. In other examples, the inlet 112 may not comprise a neck portion 118. Each inlet 112*a-b* comprises an edge 114 (i.e., a barrier) distal from the opening 116. Each inlet 112*a-b* tapers inwardly from the opening 116 to the neck portion 118, and tapers outwardly from the neck portion 118 to the edge/barrier 114. This is relative to when viewed along the y-dimension. The cross-sectional area of the inlets 112*a-b* in the illustrated example is lowest at the neck portion 118.

It may be that the resistivity of the gas burner membrane 100 (i.e., the gas burner membrane's resistance to the passage of combustible gas mixture through the gas burner membrane 100) is controlled by the narrowest section of the inlets 112*a-b*. In other words, the narrowest section of the inlets 112*a-b* may be narrower than the narrowest section of the outlets 122. In the illustrated example in FIGS. 2A-D, the resistivity of the gas burner membrane 100 may be controlled by the neck portion 118.

Figure 2B:
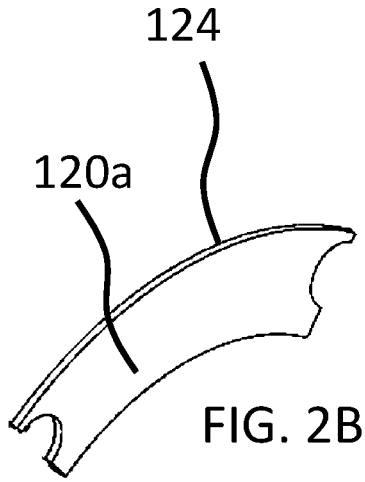
Figure 2C:
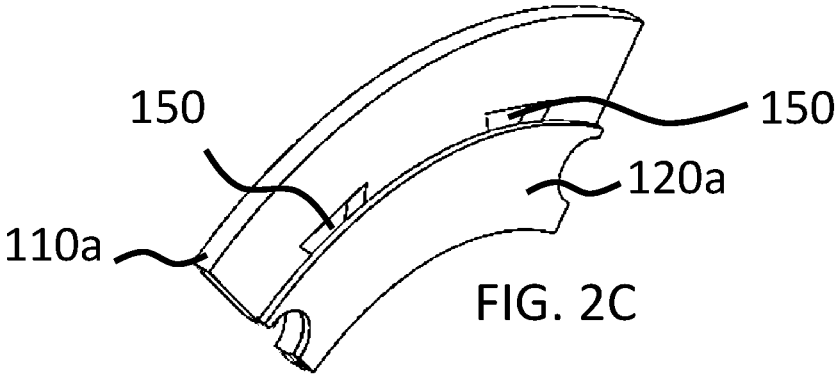

The second layers 120*a*, as illustrated in FIG. 2B, are arranged to restrict the flow of combustible gas mixture received by the inlets 112*a-b* when positioned adjoining a first layer 110*a*, as shown in FIG. 2C.

The first layers 110*a* and the second layers 120*a* are configured such that when aligned and adjoined, an escape path 150 is formed from each inlet 112*a-b* to adjoining outlets 122. As illustrated in FIGS. 2A-D, one outlet 122 is formed between successive first layers 110*a*. In other examples, a plurality of outlets 122 may be formed, see for example FIGS. 5A-C. The escape paths 150 for each inlet 112*a-b* allow the combustible gas mixture received by the inlets 112*a-b* to flow to an outlet 122 on either side (i.e., in the z-dimension) of the first layer 110*a*. This can be seen in FIG. 2D where multiple first layers 110*a* and second layers 120*a* are aligned and adjoined to form at least part of the first example gas burner membrane 100.

Each escape path 150 formed for a given first layer 110*a* is therefore aligned with escape paths 150 formed for successive first layers 110*a* in the z-direction. The escape paths may be aligned, and therefore fluidly connected with each other, along the longest extent of the gas burner membrane 100. This may at least partially form an internal flashback chamber 155, as described below in relation to FIG. 9.

Figure 2D:
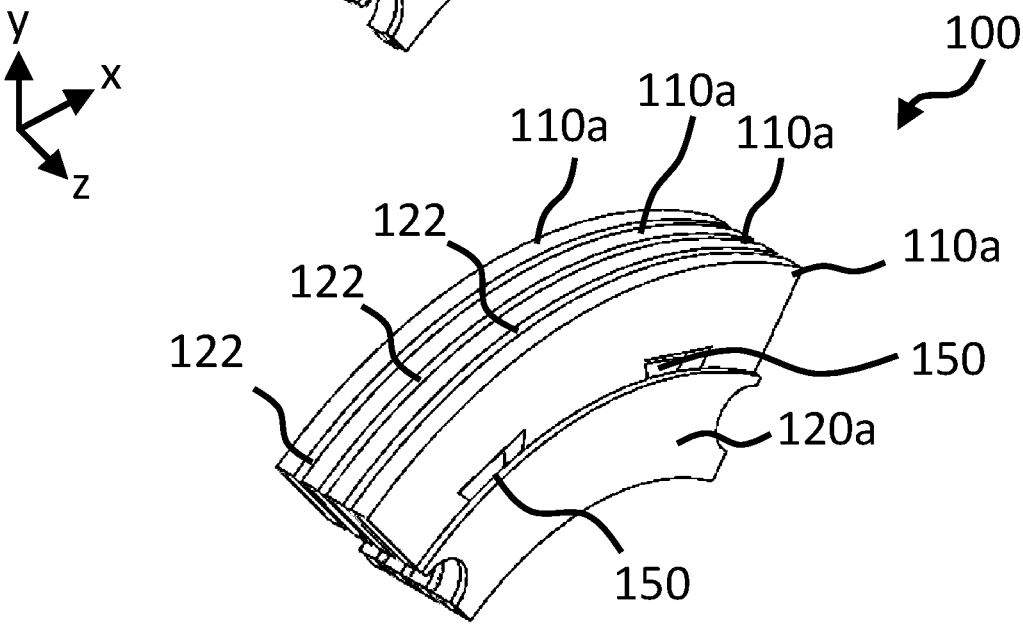

FIG. 2D illustrates a first example gas burner membrane 100 which comprises a plurality of sets of inlets, where each set of inlets is formed from a plurality of inlets 112 aligned with each other (i.e., in the z-dimension, or along the depth dimension of the layers). This is depicted by a plurality of aligned first inlets 112*a* for a first set of inlets, and a plurality of aligned second inlets 112*b* for a second set of inlets. The sets of inlets are spaced from each other in a dimension defined by the length and width of the layers, i.e., the x- and y-dimensions respectively. In spherical or cylindrical coordinates, the dimension may be defined, for example, by an azimuthal dimension.

Figure 3:
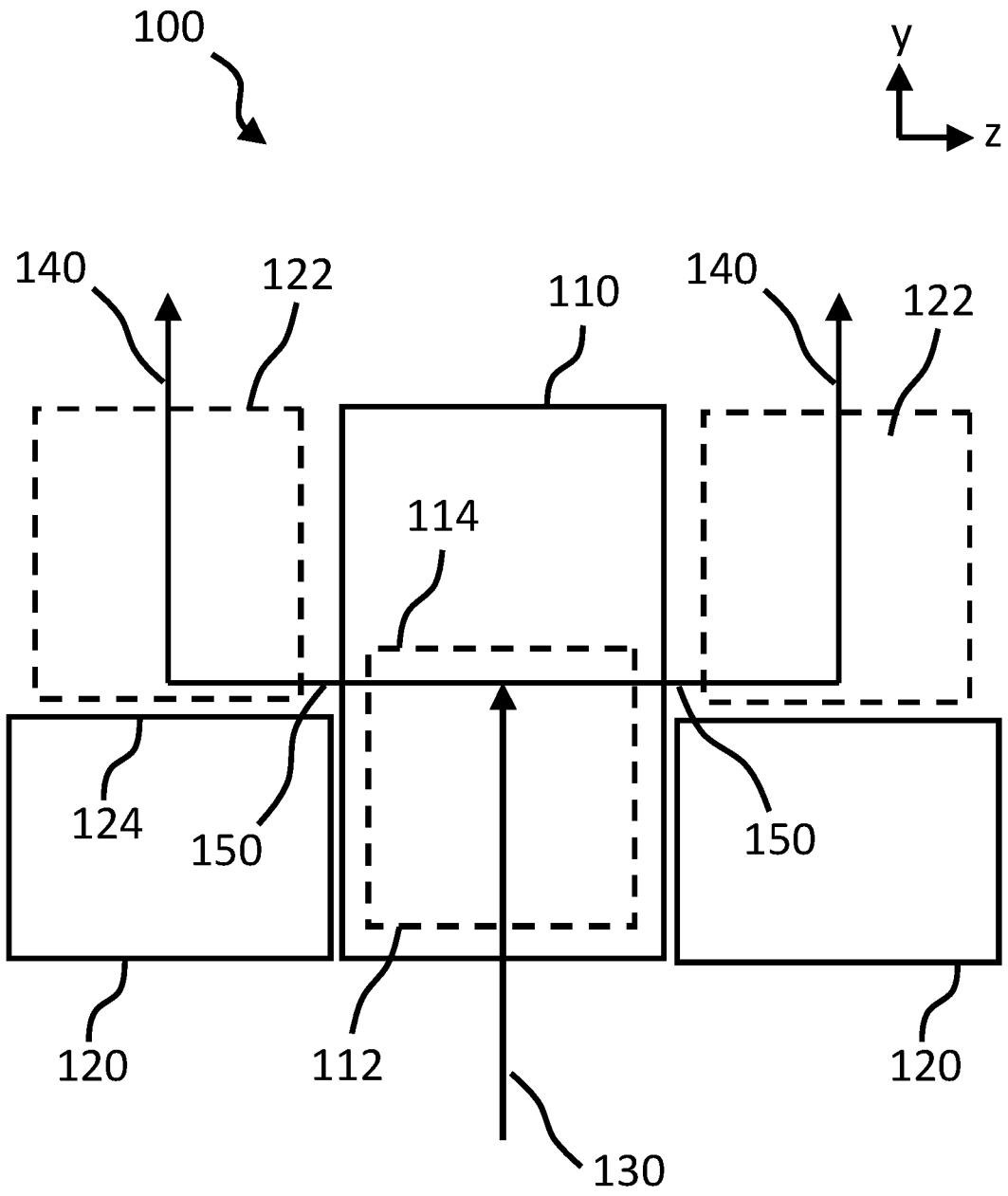
FIG. 3 shows a flow path of the first example gas burner membrane.

FIG. 3 shows a schematic diagram of a flow path of the combustible gas mixture through a first layer and adjoining second layers of the first example gas burner membrane 100.

The first layer 110 is aligned with two adjoining second layers 120 such that a plurality of escape paths 150 are formed between the inlet 112 of the first layer 110 and the adjoining outlets 122. In the illustrated example, there are two escape paths 150. Each escape path 150 allows the received combustible gas mixture to flow from the inlet 112 of the first layer 110 to the adjoining outlets 122.

In particular, this is achieved by the edge 114 (or barrier) of the inlet 112 of the first layer 110 which impedes the flow of combustible gas mixture that has been received by the inlet 112. As shown in FIG. 3, the flow path of the combustible gas mixture is deflected towards the outlets 122. Although the deflection of the flow is depicted as being orthogonal, it is envisaged that the deflected flow may have a shallower or steeper angle. In any case, the deflected flow of combustible gas mixture will, at least, exhibit an orthogonal component.

For simplicity only three discrete layers are depicted in FIG. 3, but the above may apply to any number of layers of the gas burner membrane 100. In some instances, it may be that there is only one escape path 150 formed for a given inlet 112 of the first layer 110, rather than the two depicted in FIG. 3. In other words, an outlet 122 may be arranged to only receive combustible gas mixture from one adjoining inlet 112. For example, a third layer (not shown) may be arranged between a first layer 110 and one of the adjoining second layers 120 such that the third layer blocks the flow of combustible gas mixture between the inlet 112 of the first layer 110 and the outlet 122 formed at the second layer 120. Alternatively, it may be that the first layer 110 or second layer 120 are configured to block the flow of combustible gas mixture in one direction (i.e., along the z-dimension).

During operation, the flow path of the combustible gas mixture through the gas burner membrane 100 allows a plurality of flames to be formed at the combustion side of the gas burner membrane 100. Over time, the gas burner membrane 100 reaches an operating temperature upon thermal stabilisation. The combustion side, of the gas burner membrane 100 is the hottest part due to its proximity to the created flames. The cool side of the gas burner membrane 100 is kept cool by the flow of the combustible gas mixture entering the gas burner membrane 100, which is un-combusted. The combustible gas mixture is typically at or near ambient temperature. This temperature difference counteracts thermal conductivity through the gas burner membrane 100 from the combustion side.

Figure 4:
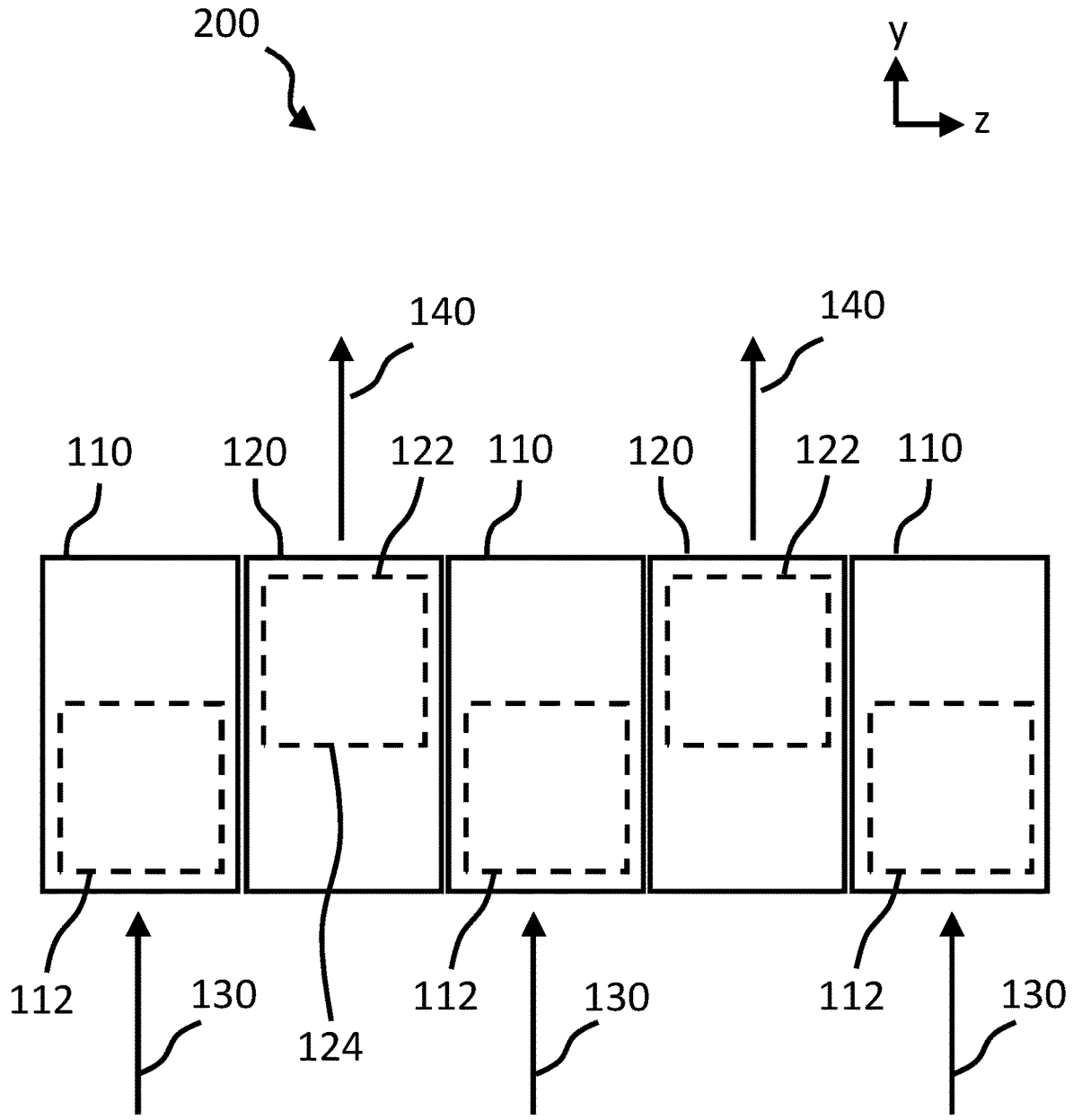
FIG. 4 shows a schematic diagram of a second example gas burner membrane.

FIG. 4 shows a schematic diagram of a second example gas burner membrane 200. The second example gas burner membrane 200 is similar to the first example gas burner membrane 100 depicted in FIGS. 1 to 3, and may be formed and arranged in a similar manner. The second layers 120 of the second example gas burner membrane 200 comprise an outlet 122 formed therein. The first layers 110 adjoining the second layers 120 of the second example gas burner membrane 200 at least partially restrict the combustible gas mixture received by the outlet 122 in the second layers 120. In this example, the edge 124 of each second layer 120, which define a boundary of the outlets 122, is located in the outlet 122 formed in the second layer 120.

Figure 5A:
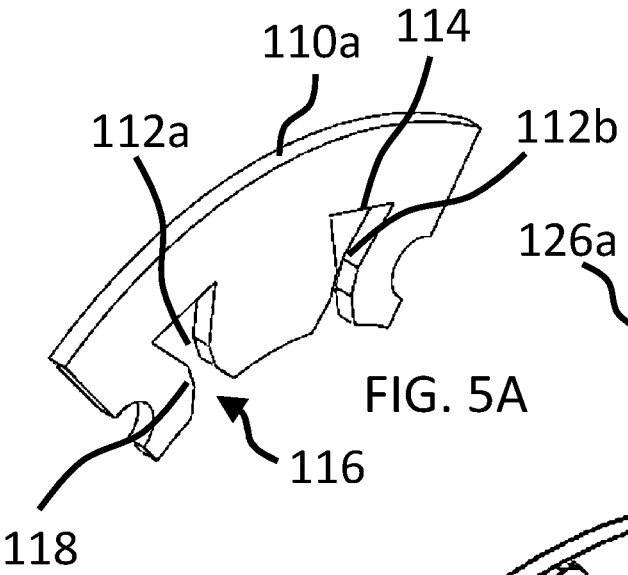

FIGS. 5A-D illustrates a first example of the first layer 110*a* and second layer 120*b* used for the second example gas burner membrane 200*a*. The first layer 110*a* illustrated in FIG. 5A is the same as that illustrated in FIG. 2A. Although the following description of the second layers 120*b* illustrated in FIG. 5A-D is in relation to the second layer of the second example gas burner membrane 200, it is envisaged that it may also relate to the second layer of the first example gas burner membrane 100, the difference being that it comprises a plurality of outlets 122.

Figure 5B:
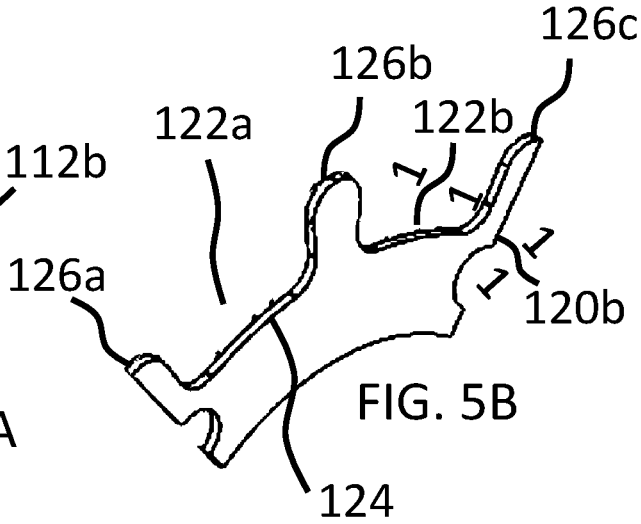
Figure 5C:
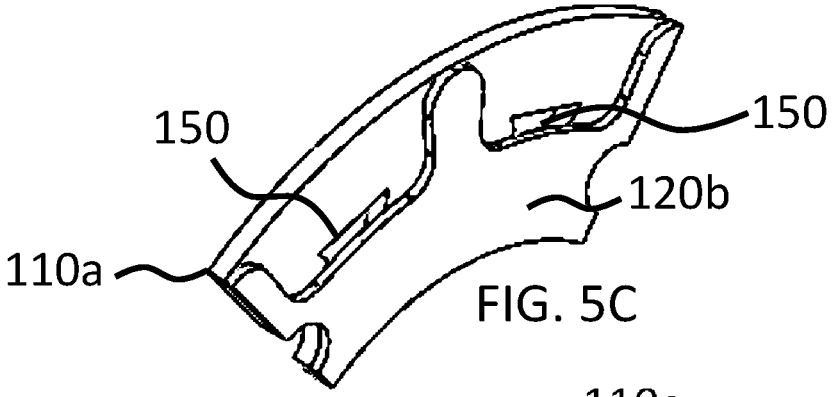
Figure 5D:
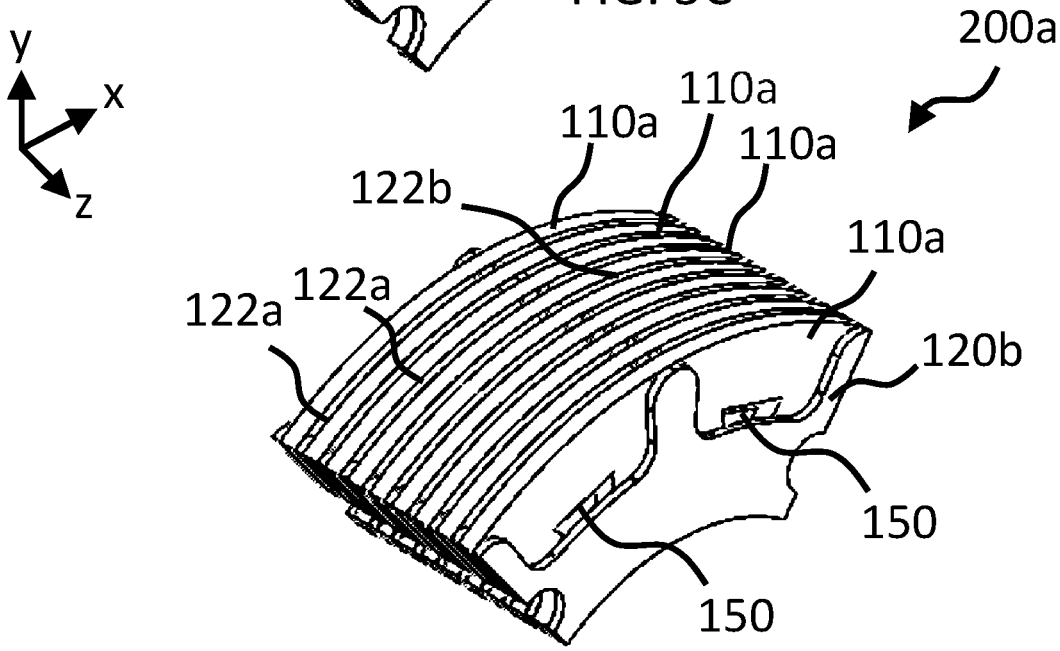

The second layer 120*b* illustrated in FIG. 5B comprises a plurality of discrete outlets 122*a-b* formed therein. In particular, the second layer 120*b* comprises a plurality of arms 126*a-c* and the arms 126 form a plurality of outlets 122*a-b* between successive first layers 110*a*. In other words, when aligned, the combustible gas mixture passing through the escape paths 150 from each inlet 112*a-b* enter a discrete outlet 122*a-b* such that the arms 126*a-c* of the second layer 120 prevent the flow of combustible gas mixture between the discrete outlets 122*a-b*. In the illustrated example, combustible gas mixture received in a first inlet 112*a* passes through a first escape path 150 into a first outlet 122*a*, and combustible gas mixture received in a second inlet 112*b* passes through a second escape path 150 into a second outlet 122*b*. In this example, the discrete outlets 122*a-b* are separated in the x-direction by the intermediate arm 126*b* of the second layer 120*b*. The outer arms 126*a*, 126*c* also restrict the flow of combustible gas mixture from the outlets 122*a-b*.

In this example, each first layer 110*a* adjoining a second layer 120*b* comprising at least one arm 126 comprises the same number of inlets 112 formed therein as outlets 122 between successive first layers 110*a*. In other words, the intermediate arm 126*b* of the second layer 120*b* is positioned between the escape paths 150 formed between adjoining first layer 110*a* and second layer 120*b*.

In this example, it can be seen (for example from FIG. 5D) that the second example gas burner membrane 200*a* comprises a plurality of sets of inlets (as depicted by first and second inlets 112*a-b*), as described above in relation to FIGS. 2A-D. In addition, the second example gas burner membrane 200*a* comprises a plurality of sets of outlets, where each set of outlets is formed from a plurality of outlets 122 aligned with each other (i.e., in the z-dimension, or along the depth dimension of the layers). This is depicted by a plurality of aligned first outlets 122*a* for a first set of outlets, and a plurality of aligned second outlets 122*b* for a second set of outlets. The sets of outlets are spaced from each other in a dimension defined by the length and width of the layers, i.e., the x- and y-dimensions respectively. In spherical or cylindrical coordinates, the dimension may be defined, for example, by an azimuthal dimension. In this example, the number of sets of outlets is the same as the number of sets of inlets, although there may be any number of sets of inlets per set of outlets.

FIGS. 6A-C illustrates a second example of the first layers 110*b* and second layers 120*c* used for the second example gas burner membrane 200*b*. Although the first layer 110*b* illustrated in FIG. 6A is designed as having a flat shape rather than being curved, it operates in the same manner as the first layer 110*a* described above in relation to FIGS. 2A-D and 5A-D.

The second layer 120*c* illustrated in FIG. 6B is similar to the second layer 120*b* illustrated in FIG. 5B and operates in a similar manner. Rather than the discrete outlets 122 being separated by arms 126*b* as illustrated in FIG. 5B, the outlets 122*c-f* are formed as cut-outs in the second layers 120*c*.

In this example, a plurality of sets of inlets and outlets are formed along the length of the layers (i.e., along the x-dimension).

Like the previous examples, the second example gas burner membrane 200*b* shown in FIG. 6C illustrates a plurality of first layers 110*b* and second layers 120*c* adjoined along the z-dimension, in an alternating sequence.

FIG. 7 shows a schematic diagram of a flow path of the combustible gas mixture through the second example gas burner membrane 200, in accordance with the examples illustrated in FIGS. 4 to 6A-C. The second example gas burner membrane 200 operates in a similar manner as described above in relation to FIG. 3.

The first layer 110 is aligned with two adjoining second layers 120 such that two escape paths 150 are formed between the inlet 112 of the first layer 110 and the outlets 122 of the adjoining second layers 120. The escape paths 150 allow the received combustible gas mixture to flow from the inlet 112 of the first layer 110 to the outlets 122 of the adjoining second layers 120. This is achieved in a similar manner as described above in relation to FIG. 3.

For simplicity only three discrete layers are depicted in FIG. 7, but the above may apply to all or some of the plurality of layers of the gas burner membrane 100. In some instances, it may be that there is only one escape path 150 formed for a given inlet 112 of the first layer 110, rather than the two depicted in FIG. 7. In other words, an outlet 122 may be arranged to only receive combustible gas mixture from one adjoining inlet 112. This may be achieved in a similar manner as described above in relation to FIG. 3.

It may be that the resistivity of the gas burner membrane 200 is controlled by the narrowest section of the first layers 110. In other words, the narrowest section of the first layers 110 may be narrower than the narrowest section of the outlets 122 of the second layers 120. This is similar to the resistivity of the first example gas burner membrane 100 described above.

FIGS. 8A-C illustrates an example of a third example gas burner membrane 300. Like the previous examples, the third example gas burner membrane 300 is formed from a plurality of successive first layers 310 and second layers 320 arranged in an alternating sequence, not shown. Although the first layer 310 and second layer 320 are shown as being curved, it is envisaged that the layers may be formed of any shape. In this example, the layers are shown in the x- and y-dimensions, showing the length and width of the layers.

A first layer 310 used for the third example gas burner membrane 300 is illustrated in FIG. 8A. The first layer 310 comprises two inlets 312*a-b* and two outlets 322*a-b* formed therein. The inlets 312*a-b* are similar to the inlets 112*a-b* formed in the first layers 110*a*, 110*b* as illustrated in FIGS. 1-7. The outlets 322*a-b* formed in the first layer 310 are spaced from the inlets 312*a-b* of the first layer 310 in a first dimension (i.e., in the x- and y-dimensions). In spherical or cylindrical coordinates, the first dimension may be defined by an azimuthal dimension.

A second layer 320 comprises two inlets 312*c-d* and two outlets 322*c-d* formed therein, as shown in FIG. 8B. In this illustrated example, the inlets 312*c-d* formed in the second layer 320 are similar to the inlets 312*a-b* formed in the first layer 310, and the outlets 322*c-d* formed in the second layer 320 are similar to the outlets 322*a-b* formed in the first layer 310. The outlets 322*c-d* formed in the second layer 320 are spaced from the formed inlets 312*c-d* of the second layer 320 in a first dimension (i.e., in the x- and y-dimensions). In spherical or cylindrical coordinates, the first dimension may be an azimuthal dimension.

The inlets 312*a-b* and outlets 322*a-b* formed in the first layer 310 are positioned such that they align with the outlets 322*c-d* and inlets 312*c-d*, respectively, in an adjoining second layer 320, as shown in FIG. 8C. For example, inlet 312*a* of the first layer 310 is aligned with outlet 322*c* of the second layer 320, inlet 312*c* of the second layer 320 is aligned with outlet 322*a* of the first layer 310, and so on.

In some instances, it may be that the second layer 320 is a first layer 310 that has been rotated about the y-axis, as per the illustrated example in FIGS. 8A-C. In other words, the inlets 312 and outlets 322 formed in the first layer 310 are positioned such that they align with the outlets 322 and inlets 312, respectively, in an adjoining first layer 310 that has been rotated about the y-dimension.

In other examples, the inlets 312 and outlets 322 of the first and second layers 310, 320 may have different shapes or sizes. It may be that the inlets 312*a-b* of the first layer 310 differ from the inlets 312*c-d* of the second layer 320. It may be that the outlets 322*a-b* of the first layer 310 differ from the outlets 322*c-d* of the second layer 320.

As illustrated in FIG. 8C, the adjoining first and second layers 310, 320 form a plurality of escape paths 350*a-d*, i.e., in the z-direction. This is achieved from inlet 312*a* being aligned with outlet 322*c* to form a first escape path 350*a*, inlet 312*c* being aligned with outlet 322*a* to form a second escape path 350*b*, inlet 312*b* being aligned with outlet 322*d* to form a third escape path 350*c*, and inlet 312*d* being aligned with outlet 322*b* to form a fourth escape path 350*d*. The escape paths 350*a-d* operate in the same way as described above.

In this example, it can be seen that fours sets of inlets and outlets are formed. The result of which is the ability to form four discrete flames from the outlets 322*a-d*.

It may be that the distance between successive first layers 310 is the same or different than the distance between successive second layers 320. In other words, the first and second layers 310, 320 may have the same or different thicknesses (defined in the z-dimension). In some examples, it may be that the distance between successive first layers 310, and/or the distance between successive second layers 320, may be at least 2 mm or less. It may be 1 mm or less, or 0.5 mm or less. The distance may depend on the application for the gas burner membrane 300 and/or the combustible gas mixture being used. It may be that the distance between successive first layers 310 is determined by the thickness, or depth, of the second layers 320. It may be that the distance between successive second layers 320 is determined by the thickness, or depth, of the first layers 310. It may be that when a hydrogen or hydrogen-rich combustible gas mixture is used, the first layers 310 and the second layers 320 of the third example gas burner membrane 300 have a thickness of 0.5 mm or less.

It can be seen from the aforementioned examples that the design and number of outlets 122 between successive first layers 110 for either the first, second or third example gas burner membrane 100, 200, 300 can dictate the number and size of flames which can be produced from the gas burner membrane 100, 200, 300.

FIG. 9 shows a schematic diagram of an internal flashback chamber 155. It may be that the gas burner membrane 100, 200, 300 comprises a plurality of layers 110, 120 which form the inlets 112, outlets 122 and an internal flashback chamber 155. The internal flashback chamber 155 is at least partially formed from the aligned inlets 112 and outlets 122 of adjoining layers 110, 120. In particular, the internal flashback chamber 155 is formed from an edge 114 of the inlets 112 formed in the first layers 110 and an edge 124 of the second layers 120. The edge 124 of the second layers 120 may be formed in accordance with the second layers 120 of the first, second or third example gas burner membrane 100, 200, 300 described above Therefore, the first, second or third example gas burner membranes 100, 200, 300 may comprise an internal flashback chamber 155.

In addition, the internal flashback chamber 155 is formed from a plurality of aligned escape paths 150 between a plurality of layers. FIG. 9 shows the internal flashback chamber 155 extending along the z-dimension as the escape paths align with each other.

The internal flashback chamber 155 is contained within the gas burner membrane 100, 200, 300. In other words, the internal flashback chamber 155 is between the cool side and the combustion side of the gas burner membrane 100, 200, 300.

The internal flashback chamber 155 comprises at least one barrier 114 arranged to impede the flow of combustible gas mixture that has been received by the plurality of inlets 112, and arranged to deflect the received combustible gas mixture towards the plurality of outlets 122. The barrier 114 is shown as the edge of the inlet 110, as described above. In other instances, the barrier of the internal flashback chamber 155 may be different.

It may be that the internal flashback chamber 155 extends substantially along the longest extent of the gas burner membrane 100, 200, 300, i.e., along the z-direction, and that the internal flashback chamber 155 comprises a respective barrier 114 for each inlet 112. However, the internal flashback chamber 155 may be any length. It may be that multiple internal flashback chambers 155 run in the same dimension such that the internal flashback chambers 155 are not in fluid connection with each other. For example, the multiple internal flashback chambers 155 in the same dimension may be separated where an outlet is only fluidly connected to one inlet, i.e., where an inlet only has one escape path, as described above.

The barrier 114 of the internal flashback chamber 155 is shaped such that the flow of the combustible gas mixture impeded by the barrier 114 has an orthogonal component at or near the barrier 114. This is similar to the edge of the inlet 112 described above in relation to FIGS. 3 and 7.

In some examples, the gas burner membrane 100, 200, 300 may comprise a plurality of internal flashback chambers 155 spaced from each other in the x- and y-directions. In examples where the gas burner membrane 100, 200, 300 comprises a plurality of sets of inlets (each set of inlets comprising a plurality of inlets 112), there may be an internal flashback chamber 155 for each set of inlets. Each internal flashback chamber 155 comprises at least one barrier 114 arranged to impede the flow of combustible gas mixture that has been received by the respective set of inlets, and arranged to deflect the received combustible gas mixture towards an outlet. The outlet may be shared by each set of inlets, as described above in relation to FIGS. 2A-D.

Additionally, or alternatively, when the gas burner membrane 100, 200, 300 comprises a plurality of sets of outlets, there may be an internal flashback chamber 155 for each set of outlets. The at least one barrier 114 of each internal flashback chamber 155 is arranged to deflect the received combustible gas mixture towards a respective set of outlets.

During operation, the gas burner membrane 100, 200, 300 reaches an operating temperature, where the combustion side reaches a higher temperature than the cool side of the gas burner membrane 100, 200, 300, as described above in relation to FIG. 3. Flashback may occur when the flame front travels into the gas burner membrane 100, 200, 300 through an outlet 122. This may occur, for example, due to the temperature of the gas burner membrane 100, 200, 300 exceeding the operation temperature, or when the combustible gas mixture becomes too rich. In accordance with the described gas burner membranes 100, 200, 300, flashback into the gas burner membrane 100, 200, 300 is a two-stage process.

The first stage of flashback is when a flame at the combustion side of the gas burner membrane 100, 200, 300 travels into an outlet 122 and then into an internal flashback chamber 155 fluidly connected to the outlet 122. The flame front there ignites the combustible gas mixture in the internal flashback chamber 155. During this first stage, the flame no longer appears at the combustion side of the gas burner membrane 100, 200, 300 at the outlet 122 as it travels inwardly into the internal flashback chamber 155.

The second, and final, stage of flashback is when the flame in the internal flashback chamber 155 travels through an inlet 112 of a first layer 110 and exits through the cool side of the gas burner membrane 100, 200, 300, igniting the combustible gas mixture being supplied to the gas burner membrane 100, 200, 300.

Therefore, the internal flashback chamber(s) 155, as illustrated in FIG. 9, is/are configured such that flashback from any outlet 122 fluidly connected to an internal flashback chamber 155 is at least temporarily contained in that internal flashback chamber 155. In other words, there is a time delay between the onset of flashback, and the ignition of combustible gas mixture at the cool side of the gas burner membrane 100, 200, 300. This therefore provides an opportunity to prevent flashback at the cool side of the gas burner membrane 100, 200, 300, i.e., the second stage of flashback. This may be achieved, for example, by ceasing or stopping the supply of combustible gas mixture to the cool side of the gas burner membrane 100, 200, 300. The flashback is contained in the internal flashback chamber 155 when the resistivity of the gas burner membrane 100, 200, 300 is controlled by the narrowest section of the inlets 112. For example, when the cross-sectional area of each outlet 122 is greater than the cross-sectional area of the narrowest portion of each inlet 112.

The first stage of the flashback may last for 2 seconds or longer. In other words, the flashback may be contained in the internal flashback chamber 155 for 2 seconds, or longer. Typically, the flashback will be contained in the internal flashback chamber 155 for between 2 and 10 seconds. The time in which the flashback is contained in the internal flashback chamber 155 may depend, for example, on the length of the internal flashback chamber 155, the combustible gas mixture being used, and the resistivity of the gas burner membrane 100, 200, 300 to the passage of the combustible gas mixture.

FIG. 10 is a flowchart of a first method 400 of forming a gas burner membrane 100, 200, 300. The method may apply for any of the above-described examples of the gas burner membrane.

The method 400 comprises providing a plurality of first layers 410. Each first layer 410 comprises at least one inlet formed therein for receiving a combustible gas mixture. The method 400 further comprises providing a plurality of second layers 420. The plurality of first and second layers are arranged in an alternating sequence 430 such that successive first layers are separated by a second layer. At least one outlet is formed between successive first layers.

FIG. 11 is a flowchart of a second method 500 of forming a gas burner membrane. The method may apply for any of the above-described examples of the gas burner membrane.

The method 500 comprises forming a plurality of inlets 510 for receiving a combustible gas mixture. For example, the plurality of inlets may be formed in a plurality of first layers, as described above. The method 500 further comprises forming a plurality of outlets 520. The outlets are for forming and maintaining a flame from the combustible gas mixture. For example, the plurality of outlets may be formed between successive first layers, and may be formed in a plurality of second layers, as described above in relation to the second example gas burner membrane 200.

The method 500 further comprises forming an internal flashback chamber 530. The internal flashback chamber comprises at least one barrier arranged to impede the flow of combustible gas mixture that has been received by the plurality of inlets, and arranged to deflect the received combustible gas mixture towards the plurality of outlets. It may be that the internal flashback chamber is formed as a result of forming the inlets and outlets. It may be that the internal flashback chamber is formed from aligning first layers (with inlets formed therein) and second layers in an alternative sequence. It may be that more than one internal flashback chamber is formed.

FIG. 12 is a flowchart of a method 600 for detecting flashback. The method may apply for any of the above-described examples of the gas burner membrane which comprises or may comprise an internal flashback chamber.

The method 600 comprises forming a gas burner membrane comprising an internal flashback chamber 610. Although FIG. 12 depicts forming a gas burner membrane in accordance with the method 500 illustrated in FIG. 11, it may, for example, also be achieved in accordance with the method 400 illustrated in FIG. 10. In other words, arranging the plurality of first and second layers in an alternating sequence may form at least one internal flashback chamber.

The method 600 further comprises, during operation, detecting an absence of a flame at any of the outlets of the gas burner membrane and/or if a temperature in the internal flashback chamber of the gas burner membrane is above a threshold 620. As described above, flashback is at least temporarily contained in the internal flashback chamber. In other words, flashback is temporarily contained in the internal flashback chamber shortly after flashback is initiated. The flashback may occur from one or more outlets. The flame(s) at the affected outlet(s) will become absent upon the onset of flashback, i.e., the first stage of flashback as described above in relation to FIG. 9. The absence of a flame(s) may be detected by a detector. The detector may, for example, be an ultra-violet (UV) sensor/detector or a thermal sensor/detector.

Additionally, or alternatively, a detector may detect an elevated temperature in the internal flashback chamber of the gas burner membrane. For example, detect if the temperature is above a threshold. The detector may, for example, be an ultra-violet (UV) sensor/detector or a thermal sensor/detector. This may be the same detector used for detecting an absence of a flame, or an additional detector. During flashback, i.e., the first stage of flashback as discussed above, the temperature of the combustible gas mixture within the internal flashback chamber is increased, which therefore increases the temperature of the internal flashback chamber. This elevated temperature in the internal flashback chamber may be detected by the detector. In examples where the detector is a thermal sensor/detector, such as a thermocouple, the detector may be placed inside the internal flashback chamber.

In some examples, it may be that the detector is in communication with control circuitry capable of processing data from the detector to determine the occurrence of flashback and ceasing combustible gas mixture from entering the gas burner membrane (e.g., through the inlets of the gas burner membrane). The control circuitry may be configured to recognize the onset of flashback from data from the detector, for example by monitoring a flame profile of the gas burner membrane during operation. For example, an absence of one or more flames will alter the flame profile and allow detection of flashback. Additionally, or alternatively, an elevated temperature in the internal flashback chamber, such as when the flashback is contained in the internal flashback chamber, will also alter the flame profile and allow detection of flashback. It may be that flashback is detected when the temperature in the internal flashback chamber is above a threshold, which is indicative that the flashback is contained in the internal flashback chamber. Upon recognition of the onset of flashback, the control circuitry may stop combustible gas mixture from entering the gas burner membrane, for example by closing a valve.

The internal flashback chamber therefore provides time to detect the onset of flashback and stop the operation of the gas burner membrane before the flashback exits the gas burner membrane through the cool side of the gas burner membrane. In this manner, the method 600 can prevent the second stage of flashback, as described above in relation to FIG. 9.

The term 'comprise' is used in this document with an inclusive not an exclusive meaning. That is any reference to X comprising Y indicates that X may comprise only one Y or may comprise more than one Y. If it is intended to use 'comprise' with an exclusive meaning then it will be made clear in the context by referring to "comprising only one . . . " or by using "consisting".

In this description, reference has been made to various examples. The description of features or functions in relation to an example indicates that those features or functions are present in that example. The use of the term 'example' or 'for example' or 'can' or 'may' in the text denotes, whether explicitly stated or not, that such features or functions are present in at least the described example, whether described as an example or not, and that they can be, but are not necessarily, present in some of or all other examples. Thus 'example', 'for example', 'can' or 'may' refers to a particular instance in a class of examples. A property of the instance can be a property of only that instance or a property of the class or a property of a sub-class of the class that includes some but not all of the instances in the class. It is therefore implicitly disclosed that a feature described with reference to one example but not with reference to another example, can where possible be used in that other example as part of a working combination but does not necessarily have to be used in that other example.

Although examples have been described in the preceding paragraphs with reference to various examples, it should be appreciated that modifications to the examples given can be made without departing from the scope of the claims. For example, the first layers 110 and second layers 120 need not have the same shape as those illustrated in FIGS. 2A-D, 5A-D, 6A-C and 8A-C. The shape of the inlets 112 and the outlets 122 need not be the same as illustrated in 1, 2A-D, 3, 4, 5A-D, 6A-C, 7, 8A-C and 9. The edges 114 of the first layers 110 and the edges 124 of the second layers 120 need not have the same shape as those illustrated in FIGS. 1, 2A-D, 3, 4, 5A-D, 6A-C, 7, 8A-C and 9.

Features described in the preceding description may be used in combinations other than the combinations explicitly described above.

Although functions have been described with reference to certain features, those functions may be performable by other features whether described or not.

Although features have been described with reference to certain examples, those features may also be present in other examples whether described or not.

The term 'a' or 'the' is used in this document with an inclusive not an exclusive meaning. That is any reference to X comprising a/the Y indicates that X may comprise only one Y or may comprise more than one Y unless the context clearly indicates the contrary. If it is intended to use 'a' or 'the' with an exclusive meaning then it will be made clear in the context. In some circumstances the use of 'at least one' or 'one or more' may be used to emphasis an inclusive meaning but the absence of these terms should not be taken to infer any exclusive meaning.

The presence of a feature (or combination of features) in a claim is a reference to that feature or (combination of features) itself and also to features that achieve substantially the same technical effect (equivalent features). The equivalent features include, for example, features that are variants and achieve substantially the same result in substantially the same way. The equivalent features include, for example, features that perform substantially the same function, in substantially the same way to achieve substantially the same result.

In this description, reference has been made to various examples using adjectives or adjectival phrases to describe characteristics of the examples. Such a description of a characteristic in relation to an example indicates that the characteristic is present in some examples exactly as described and is present in other examples substantially as described.

Whilst endeavouring in the foregoing specification to draw attention to those features believed to be of importance it should be understood that the Applicant may seek protection via the claims in respect of any patentable feature or combination of features hereinbefore referred to and/or shown in the drawings whether or not emphasis has been placed thereon.

We claim:

1. A gas burner membrane comprising:

a plurality of first layers, wherein each first layer comprises at least one inlet formed therein for receiving a combustible gas mixture, wherein each inlet comprises:
an opening;
a neck portion proximal to the opening: and
a barrier distal from the opening;
wherein each inlet tapers inwardly from the opening to the neck portion, and tapers outwardly from the neck portion to the barrier; and a plurality of second layers, wherein successive first layers are separated by a second layer, and wherein at least one outlet is formed between successive first layers.

2. The gas burner membrane according to claim 1, wherein the gas burner membrane comprises an alternating sequence of first and second layers.

3. The gas burner membrane according to claim 1, wherein each first layer is aligned with adjoining second layers such that an escape path is formed between the inlet of the first layers and adjoining outlets, wherein the escape path allows the received combustible gas mixture to flow from the inlet of the first layer to the adjoining outlets.

4. The gas burner membrane according to claim 1, wherein each of the second layers comprises the at least one outlet formed therein, wherein each first layer is aligned with adjoining second layers such that an escape path is formed between the inlet of the first layer and the outlets of adjoining second layers, wherein the escape path allows the received combustible gas mixture to flow from the inlet of the first layer to the outlets of adjoining second layers.

5. The gas burner membrane according claim 4, wherein at least one first layer comprises at least one outlet formed therein, the outlet formed in the first layer being spaced from the formed inlet of the first layer in a first dimension, and wherein at least one second layer adjoining the at least one first layer comprises at least one inlet formed therein, the inlet formed in the second layer being spaced from the formed outlet of the second layer in the first dimension such that a further escape path is formed between the outlet of the first layer and the inlet of the adjoining second layer.

6. The gas burner membrane according to claim 1, wherein at least one second layer comprises at least one arm, such that the at least one arm forms a plurality of outlets between successive first layers, wherein each first layer adjoining a second layer comprising at least one arm comprises the same number of inlets formed therein as outlets between successive first layers, such that each arm of the second layer is positioned between inlets formed in each first layer.

7. The gas burner membrane according to claim 1, wherein the first and second layers have a length, width and depth, wherein the length is longer than the width and depth, the width is shorter than the length and longer than the depth, and the depth is shorter than the length and the width, wherein the gas burner membrane comprises a plurality of sets of inlets, wherein each set of inlets comprises a plurality of inlets, and wherein the inlets of each set are aligned with each other along a dimension defined by the depth of the layers and the plurality of sets of inlets are spaced from each other in a dimension defined by the length and width of the layers.

8. The gas burner membrane according to claim 7, wherein the gas burner membrane comprises a plurality of sets of outlets, wherein each set of outlets comprises a plurality of outlets, and wherein the outlets of each set are aligned with each other along a dimension defined by the depth of the layers and the plurality of sets of outlets are spaced from each other in a dimension defined by the length and width of the layers.

9. The gas burner membrane according to claim 7, wherein the depth is further defined by the longest extent of the gas burner membrane.

10. The gas burner membrane according to claim 1, wherein the cross-sectional area of each outlet is greater than the cross-sectional area of the narrowest portion of each inlet.

11. The gas burner membrane according to claim 1, wherein the cross-sectional area of the inlet is lowest at the neck portion.

12. The gas burner membrane according to claim 1, wherein the first and second layers have a length, width and depth, wherein the length is longer than the width and depth, the width is shorter than the length and longer than the depth, and the depth is shorter than the length and the width, wherein each second layer has a depth of 2 mm or less.

13. A gas burner membrane comprising:

a plurality of inlets for receiving a combustible gas mixture, wherein each inlet is formed in a respective layer, wherein each inlet comprises;
an opening;
a neck portion proximal to the opening: and
barrier distal from the opening:
wherein each inlet tapers inwardly from the opening to the neck portion, and tapers outwardly from the neck portion to the barrier; and a plurality of outlets for forming and maintaining a flame from the combustible gas mixture, wherein the outlets are formed between successive layers.

14. A gas burner membrane comprising:

a plurality of inlets for receiving a combustible gas mixture, wherein each inlet comprises:
an opening;
a neck portion proximal to the opening; and
a barrier distal from the opening:
wherein each inlet tapers inwardly from the opening to the neck portion, and tapers outwardly from the neck portion to the barrier;

a plurality of outlets for forming and maintaining a flame from the combustible gas mixture; and an internal flashback chamber comprising at least one barrier arranged to impede the flow of combustible gas mixture that has been received by the plurality of inlets, and arranged to deflect the received combustible gas mixture towards the plurality of outlets.

15. The gas burner membrane according to claim 14, wherein the barrier of the internal flashback chamber is shaped such that the flow of the combustible gas mixture impeded by the barrier has an orthogonal component at or near the barrier.

16. The gas burner membrane according to claim 14, wherein the internal flashback chamber comprises a respective barrier for each inlet.

17. The gas burner membrane according to claim 14, wherein the internal flashback chamber extends substantially along the longest extent of the gas burner membrane.

18. The gas burner membrane according to claim 14, wherein the gas burner membrane comprises:

a plurality of sets of inlets, wherein each set of inlets comprises a respective plurality of inlets; and a respective internal flashback chamber for each set of inlets, each internal flashback chamber comprising a respective at least one barrier arranged to impede the flow of combustible gas mixture that has been received by the respective set of inlets, and arranged to deflect the received combustible gas mixture towards a respective outlet.

19. The gas burner membrane according to claim 18, wherein the gas burner membrane comprises a plurality of sets of outlets, wherein each set of outlets comprises a respective plurality of outlets, and wherein the at least one barrier of each internal flashback chamber is arranged to deflect the received combustible gas mixture towards a respective set of outlets.

20. The gas burner membrane according to claim 14, wherein the gas burner membrane comprises a plurality of layers which form the inlets, outlets and internal flashback chamber.

* * * * *